US010087025B2

(12) United States Patent
Konno et al.

(10) Patent No.: US 10,087,025 B2
(45) Date of Patent: Oct. 2, 2018

(54) IMAGE FORMING APPARATUS

(71) Applicant: KONICA MINOLTA, INC., Chiyoda-ku, Tokyo (JP)

(72) Inventors: Shinobu Konno, Hachioji (JP); Yuki Yamauchi, Nishitokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/682,110

(22) Filed: Aug. 21, 2017

(65) Prior Publication Data

US 2018/0052416 A1 Feb. 22, 2018

(30) Foreign Application Priority Data

Aug. 22, 2016 (JP) ..... 2016-162111

(51) Int. Cl.

| | |
|---|---|
| ***B65H 9/04*** | (2006.01) |
| ***B65H 9/00*** | (2006.01) |
| ***G03G 15/00*** | (2006.01) |
| ***B41J 13/036*** | (2006.01) |
| *B41J 13/10* | (2006.01) |
| *B41J 13/08* | (2006.01) |
| *G03G 15/24* | (2006.01) |

(52) U.S. Cl.

CPC ..... *B65H 9/004* (2013.01); *B41J 13/036* (2013.01); *G03G 15/6564* (2013.01); *G03G 15/6567* (2013.01); *B41J 13/08* (2013.01); *B41J 13/103* (2013.01); *B65H 2301/331* (2013.01); *G03G 15/24* (2013.01); *G03G 15/6529* (2013.01); *G03G 2215/00565* (2013.01)

(58) Field of Classification Search

CPC ..... B65H 9/004; B65H 9/006; B65H 9/008; B65H 2301/331; G03G 15/6567; G03G 15/6564

USPC ..... 271/242

See application file for complete search history.

(56) References Cited

U.S. PATENT DOCUMENTS

| | | | | |
|---|---|---|---|---|
| 5,543,909 A * | 8/1996 | Quesnel | B65H 9/006 | 271/228 |
| 5,738,349 A * | 4/1998 | Shirasaki | G03G 15/6561 | 271/242 |
| 5,933,697 A * | 8/1999 | Onodera | B65H 5/062 | 271/188 |
| 6,148,172 A * | 11/2000 | Kanda | B65H 3/44 | 271/242 |
| 7,212,321 B2 * | 5/2007 | Sugiyama | B65H 9/006 | 271/186 |

(Continued)

FOREIGN PATENT DOCUMENTS

JP 2015-024925 A 2/2015

*Primary Examiner* — Ernesto A Suarez
(74) *Attorney, Agent, or Firm* — Buchanan Ingersoll & Rooney PC

(57) ABSTRACT

An image forming apparatus performs skew correction by bringing a leading end of a conveyed sheet in contact with a registration roller pair being in a stopped state and by forming a first loop with a loop roller pair, and thereafter, refeeds the sheet to an image former by adjusting timing. In a case of feeding a sheet with a length equal to or longer than a prescribed length, after having formed the first loop, the image forming apparatus forms a second loop in a loop accommodator that is disposed on an upstream side than the loop roller pair and accommodates a formed loop.

9 Claims, 13 Drawing Sheets

(56) References Cited

U.S. PATENT DOCUMENTS

| | | | | |
|---|---|---|---|---|
| 8,099,037 | B2 * | 1/2012 | Sekine | B65H 9/002 271/228 |
| 8,434,753 | B2 * | 5/2013 | Fukatsu | B26D 5/00 270/58.07 |
| 9,367,016 | B2 * | 6/2016 | Jones | G03G 15/6567 |
| 2008/0237967 | A1 * | 10/2008 | Suzuki | B65H 5/062 271/10.16 |

* cited by examiner

IMAGE FORMING APPARATUS

CROSS-REFERENCE TO RELATED APPLICATION

This application is based on Japanese Patent Application No. 2016-162111 filed on Aug. 22, 2016, including description, claims, drawings, and abstract, the entire disclosure is the contents of which are incorporated herein by reference in its entirety.

BACKGROUND

1. Technical Field

The present invention relates to an image forming apparatus.

2. Description of Related Arts

Generally, in image forming apparatuses, if inclination or distortion (so-called "skew") has occurred on a paper sheet (hereafter, merely referred to as a sheet) at the time of image formation, the quality of formed images deteriorates. For this reason, a technique has been developed so as to correct inclination and distortion (hereinafter, may be referred to as "skew correction") before image formation. For example, a technique has been known that performs skew correction for a sheet fed from a sheet feeding apparatus to an image forming apparatus by bringing the sheet in contact with a registration roller or the like.

However, a common sheet feeding apparatus includes a regulator to align sheets loaded on a loading tray. Accordingly, in the case of performing skew correction especially for a long sheet, the trailing end of the long sheet comes in contact with the regulator, which likely leads to lower the accuracy of the skew correction. In recent years, relative to an A4 size sheet with a length of 210 mm in a conveyance direction, some of frequently-used long sheets have a length exceeding 1000 mm. If an A4 size sheet inclines by one degree, its trailing end is displaced by about 3.67 mm. On the other hand, if a long sheet with a length exceeding 1000 mm in a conveyance direction inclines by one degree, its trailing end is displaced by 17.45 mm. In this way, in the case where the trailing end of a sheet is displaced greatly, the sheet is twisted due to this displacement. In response to a force going to eliminate this twist according to the rigidity of the sheet, the regulation force for the sheet by the regulator increases, which affects also the skew correction on the leading end side. Furthermore, sheet trouble such as bending may occur because the sheets may not withstand the increased regulation forth.

Then, a technique has also developed that prevents sheets from coming in contact with a regulator by separating the regulator from the sheets at the time of performing skew correction for a sheet (for example, refer to Japanese Unexamined Patent Publication No. 2015-24925).

However, in the case of separating the regulator from the sheets, misalignment tends to occur on the sheets loaded on the loading tray. As a result, there is a fear that the misalignment leads to sheet feeding trouble. In particular, in the case where the number of stacked sheets is large or many, if the misalignment has happened once, since the weight of the sheets is too heavy (for example, in the case of A3 size sheet, the weight of 5000 sheets becomes about 50 kg), it is extremely difficult to restore the original state so as not to cause the bending or curling of sheets.

SUMMARY

The present invention has been achieved in view of the above-mentioned circumstances. That is, an object of the present invention is to provide an image forming apparatus that prevents sheet trouble caused by regulation of a regulator while maintaining skew correction with high precision.

To achieve at least one of the abovementioned objects, according to an aspect of the present invention, an image forming apparatus reflecting one aspect of the present invention includes:

an image former that forms an image on a sheet;

a loading tray on which a plurality of sheets is loaded;

a regulator that regulates side faces, in a width direction orthogonal to a conveyance direction, of sheets loaded on the loading tray;

a sheet feeder that feeds a uppermost sheet of the sheets loaded on the loading tray;

a conveyance passage on which a sheet fed from the sheet feeder is conveyed;

a registration roller pair disposed on the conveyance passage;

a loop roller pair disposed on a one-stage upstream side than the registration roller pair;

a loop accommodator disposed on an upstream side than the loop roller pair on the conveyance passage so as to accommodated a formed loop; and a processor that performs skew correction by bringing a leading end of a conveyed sheet in contact with the registration roller pair being in a stopped state and by forming a first loop with the loop roller pair, and thereafter, refeeds the sheet to the image former by adjusting timing, wherein in a case of feeding a sheet with a length equal to or longer than a prescribed length, the processor forms a second loop in the loop accommodator after having formed the first loop and before refeeding the sheet.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
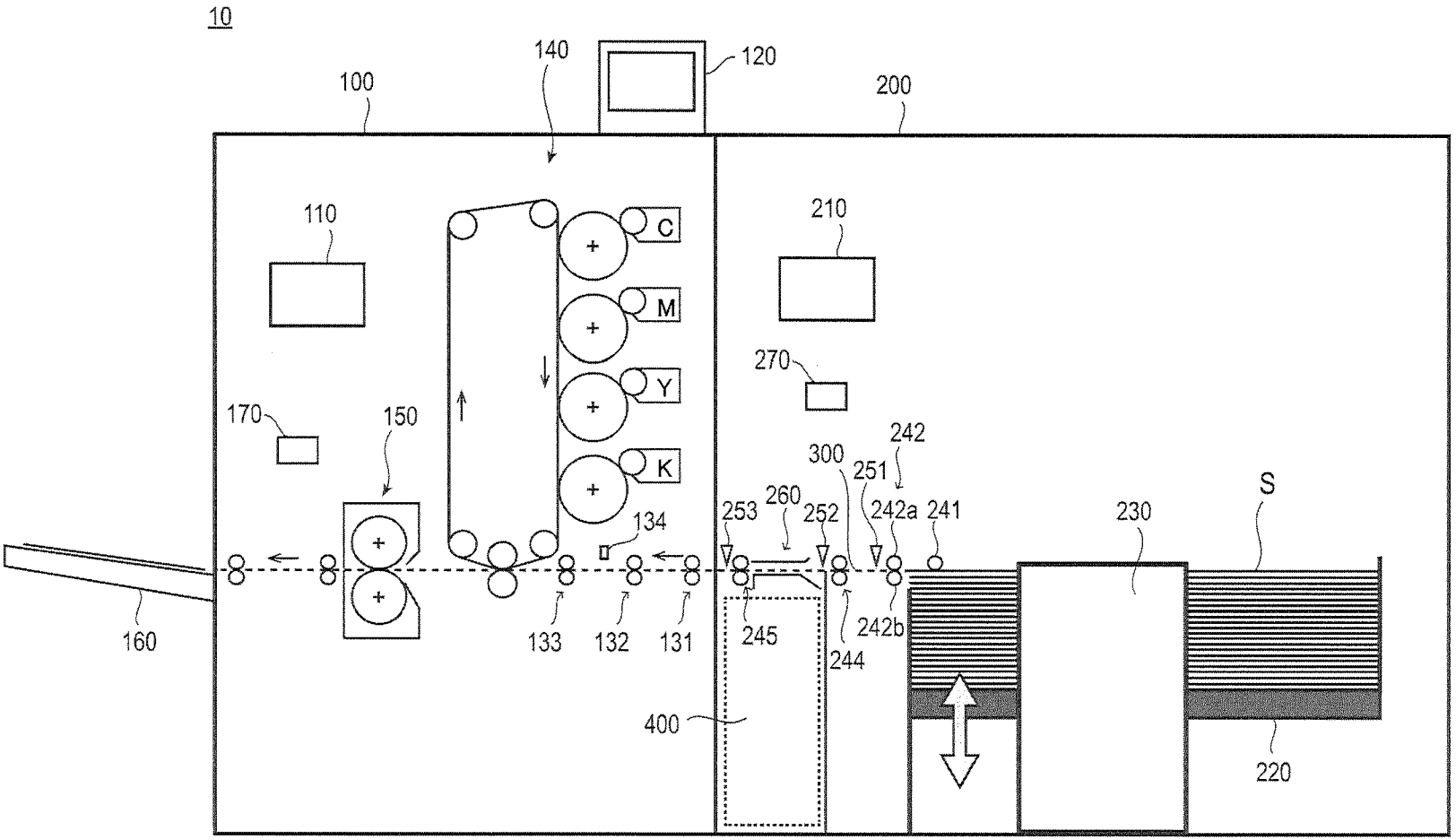
FIG. 1 is a schematic constitution diagram of an image forming apparatus.

Hereinafter, one or more embodiments of the present invention will be described with reference to the drawings. However, the scope of the invention is not limited to the disclosed embodiments. In the description of the drawings, the same sign is given to the same element, and duplicate description is omitted. Since dimension ratios in the drawings are exaggerated for convenience of description, the ratios may be different from the actual ratios.

[Image Forming Apparatus 10] FIG. 1 is a schematic constitution diagram of the image forming apparatus 10. Hereinafter, with reference to FIG. 1, the schematic constitution of the image forming apparatus 10 will be described.

(1) Overall Constitution

As shown in FIG. 1, the image forming apparatus 10 includes an image forming apparatus body 100 and a sheet feeding apparatus 200. The image forming apparatus body 100 and the sheet feeding apparatus 200 are, for example, continuously connected from the downstream side of the conveyance direction of a sheet S toward the upstream side (in the order shown in the diagram). The sheet S is conveyed on a conveyance passage 300 (indicated with a broken line in the diagram) that is extended so as to exist all over from the sheet feeding apparatus 200 to the image forming apparatus body 100 in the image forming apparatus 10. A pair of guide plates is disposed so as to face each other across a conveyance path of the conveyance passage 300 on which the sheet is conveyed, and further, a plurality of pairs of guide plates are disposed over the whole conveyance passage 300. However, in FIG. 1, only a part of the plurality of pairs of guide plates (guide plates in a loop accommodator 260 mentioned later) is shown, and the other guide plates are omitted.

The sheet feeding apparatus 200 can feed and convey a long sheet as mentioned later, and is constituted to be separable from the image forming apparatus body 100.

(2) Image Forming Apparatus Body 100

Examples of the image forming apparatus body 100 include a printer, a copying machine, a facsimile, a multifunction peripheral (MFP), etc. that have at least a function to form images on the sheet S.

As a specific hardware constitution, as shown in FIG. 1, the image forming apparatus body 100 includes a processor 110, a touch panel 120, a plurality of conveying roller pairs 131, 132, and 133, a registration sensor 134, an image former 140, a fixer 150, a sheet deliverer 160, and a communicator 170.

(2-1) Processor 110

The processor 110 controls the whole image forming apparatus 10. For example, the processor 110 includes a CPU (Central Processing Unit), a memory, and a storage.

The CPU is a control circuit that includes multi core processors etc. that execute control for each component and various kinds of arithmetic processing in accordance with programs. Each function of the image forming apparatus body 100 is exerted by executing a corresponding program by the CPU.

The memory is a main memory device that memorizes programs and data temporarily as a work region and enables rapid access. Adoptable examples of the memory include DRAM (Dynamic Random Access Memory), SDRAM (Synchronous Dynamic Random Access Memory), and SRAM (Static Random Access Memory).

The storage is a large capacity auxiliary storage device that stores various programs including operating systems and various kinds of data. Adoptable examples of the storage include a hard disk, a solid state drive, a flash memory, and a ROM (Read Only Memory).

(2-2) Touch Panel 120

The touch panel 120 includes a display portion (not shown), such as a display, and a transparent operation panel pasted on a display surface side of the display portion. The touch panel 120 specifies a touch position corresponding to the XY coordinates of an image displayed on the display portion, converts the touch position into the coordinates, and outputs it. The touch panel 120 includes input detecting elements of a pressure sensitive type or an electrostatic type.

(2-3) Conveying Roller Pairs 131, 132, and 133

As shown in FIG. 1, on the conveyance passage 300 of the image forming apparatus body 100, there are provided a plurality of conveying roller pairs 131, 132, and 133 in each of which two rollers are paired, and each of the plurality of conveying roller pairs 131, 132, and 133 pinches the sheet S, which has been fed from the sheet feeding apparatus 200 and is conveyed on the conveyance passage 300, and conveys the sheet S to the downstream side.

Among these conveying roller pairs, the conveying roller pairs 133 and 132 are also called a "registration roller pair" and a "loop roller pair", respectively. Hereinafter, the conveying roller pairs 133 and 132 are also referred to as the registration roller pair 133 and the loop roller pair 132, respectively. As described below, the registration roller pair 133 functions also as a skew corrector by cooperating with the loop roller pair 132 disposed on the one stage upstream side. Moreover, in addition to the performance of the skew correction of the sheet S, at the time of performing sheet refeeding, the registration roller pair 133 performs positioning between an image (toner image) formed on an intermediate transfer belt of the image former 140 and the sheet S by adjusting timing.

(2-4) Skew Corrector

The registration roller pair 133 in the state where a nip portion is formed between two rollers coming in press contact with each other, stops rotation temporarily at the time of performing the skew correction of the sheet S. Then, the leading end of the sheet S is brought in contact with the nip portion. In this state, the loop roller pair 132 disposed on the upstream side is driven and rotated, whereby a loop is formed on the sheet S between the registration roller pair 133 and the loop roller pair 132. This loop is also called slack. Hereinafter, the loop formed on the immediately upstream side of the registration roller pair 133 is called a "first loop". When the first loop is formed, the leading end of the sheet S becomes parallel to the axial direction of the registration roller pair 133. In this way, after the skew of the leading end of the sheet S is corrected, the registration roller pair 133 is driven and rotated. With this, while the inclination or distortion of the whole sheet S is being corrected, the sheet S is conveyed to a transfer position (a position at which a toner image is transferred from an intermediate transfer belt mentioned later onto the sheet S) of the image former 140.

The conveying roller pairs 131 to 133 are connected to a motor. The motor is controlled by the processor 110, and rotates the conveying roller pair 131 to 133 separately or integrally as required.

(2-5) Registration Sensor 134

The registration sensor 134 detects the end (leading end) of the sheet S in the sub-scanning direction (hereinafter, also referred to as a "conveyance direction"). For example, the registration sensor 134 includes a photo-sensor. The registration sensor 134 is disposed at a predetermined position located on the upstream side of a position where the sheet S arrives at the registration roller pair 133 (for example, a position on the upstream side by several centimeters from the registration roller pair 133).

(2-6) Image Former 140

The image former 140 forms a toner image by an image creating process, such as an electrophotographying system, and transfers the toner image onto the sheet S conveyed from the registration roller pair 133 by sheet-refeeding with adjusted timing. For example, the image former 140 adopts a tandem system that has independent photoconductor drums for respective colors of C (cyan), M (magenta), Y (yellow), and K (black). The respective color toner images formed on the photoconductor drums (C, M, Y, K) are transferred one by one on an intermediate transfer belt, whereby a toner image (color image), in which the respective color toner image layers are superimposed on each other, is formed on the intermediate transfer belt. Here, the intermediate transfer belt is an endless belt and is wound around a plurality of rollers so that the intermediate transfer belt is supported to be movable. Successively, a bias voltage with a polarity reverse to that of toner is applied to a transfer roller, whereby the toner image formed on the intermediate transfer belt is transferred onto the sheet S.

However, in place of the above tandem system, the image former 140 may adopt a rotary system. Also, it may be possible to adopt a system (an ink jet system, an impact system, a heat transfer system, etc.) other than the electrophotographying system.

(2-7) Fixer 150

The fixer 150 heats the toner image transferred on the sheet S so as to fix the toner image onto the sheet S. For example, the fixer 150 brings a heating member being a heat source in pressure contact with a pressing member. With this, the sheet S is applied with heat and pressure in a fixing nip portion, so that a toner image is fused and fixed.

(2-8) Sheet Deliverer 160

The sheet deliverer 160 is a sheet delivery tray on which the sheet S on which the image is formed, is stacked. After the sheet S has passed the fixer 150, the sheet S is delivered by the driving of sheet delivering rollers to the sheet deliverer 160.

(2-9) Communicator 170

The communicator 170 is an interface to communicate with the sheet feeding apparatus 200. The communicator 170 transmits and receives various setting values and various kinds of information required for an operation timing control with the sheet feeding apparatuses 200.

(3) Sheet Feeding Apparatus 200

Figure 2:
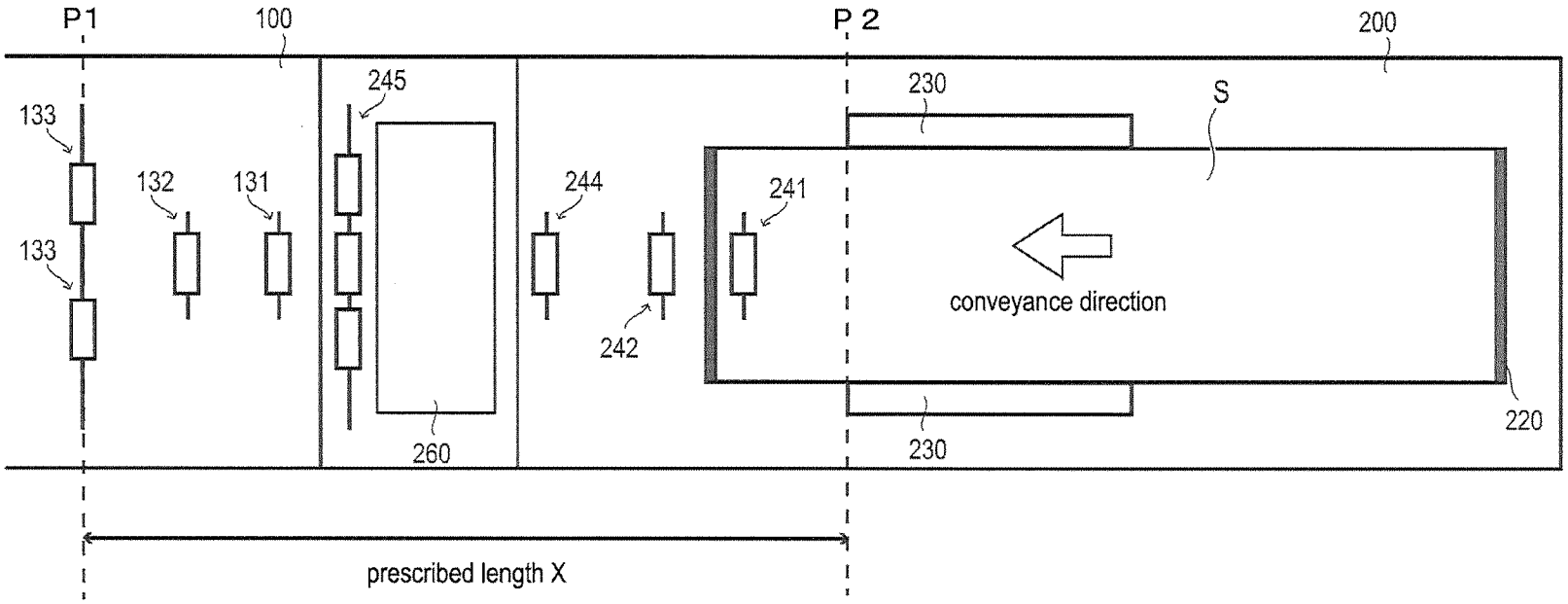
FIG. 2 is a top view in which a conveyance section from a loading tray to a skew corrector is enlarged.
Figure 3:
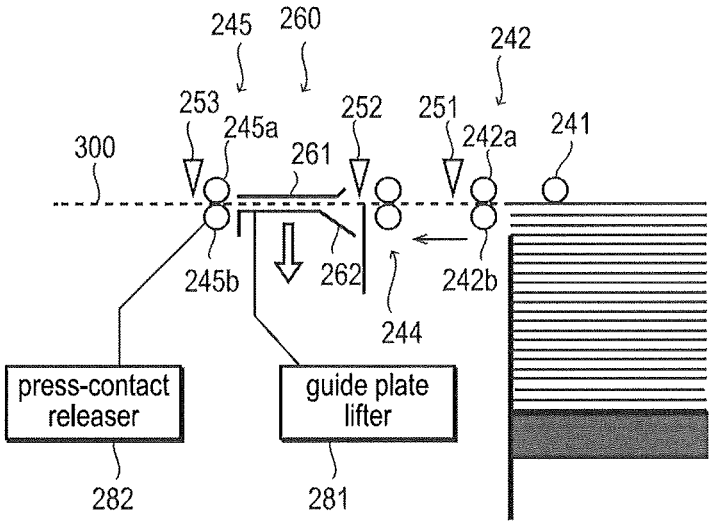
FIG. 3 is an enlarged view of the vicinity of a loop accommodator, and is an illustration showing a "closed state".
Figure 4:
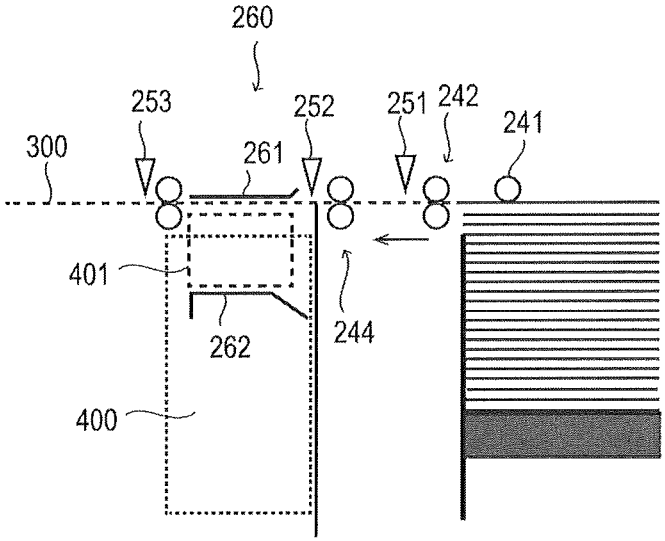
FIG. 4 is an enlarged view of the vicinity of a loop accommodator, and is an illustration showing an "opened state".

Hereinafter, with reference to FIGS. 2 to 4 together with FIG. 1, the schematic constitution of the sheet feeding apparatus 200 will be described. FIG. 2 is a top view in which a conveyance section from the loading tray 220 to the registration roller pair 133 is enlarged. Each of FIG. 3 and FIG. 4 is an enlarged view of the periphery of the loop accommodator 260. The sheet feeding apparatus 200 feeds sheet S to the image forming apparatus body 100 that enables the skew correction of the sheet S.

As a specific hardware constitution, as shown in FIG. 1 and FIG. 3, the sheet feeding apparatus 200 includes a processor 210, a loading tray 220, a regulator 230, a pickup roller 241, a separator 242, conveying roller pairs 244 and 245, sensors 251, 252, and 253, a loop accommodator 260, a communicator 270, a guide plate lifter 281, and a press-contact releaser 282.

(3-1) Processor 210

The processor 210 controls the whole sheet feeding apparatus 200. For example, the processor 210 includes a CPU, a memory, and a storage. The CPU, the memory, and the storage can be realized with the respective similar constitutions in the image forming apparatus body 100. Accordingly, description is omitted.

(3-2) Loading Tray 220

The loading tray 220 loads a plurality of sheets S thereon. The loading tray 220 is connected to a motor etc. and includes a vertically-movable structure as shown in FIG. 1. On the loading tray 220, sheets of various sheet sizes and various sheet types can be loaded. For example, on the loading tray 220, in addition to sheets of fixed sheet sizes (B5, A4, A3, etc.), long sheets longer in a conveyance direction than the sheets of fixed sheet sizes can be loaded. Moreover, on the loading tray 220, sheets with basis weight (basis weight is 60 to 250 g/m$^2$) within a predetermined range from thicker paper sheets to thinner paper sheets can be loaded. The height of sheets loaded on the loading tray 220 is detected by an unillustrated sensor. At the time of feeding sheets, in response to the output of the above sensor, the height of the loading tray 220 is adjusted to become a sheet feeding position where the uppermost (topmost) sheet of the loaded sheets comes in contact with the pickup roller 241.

(3-3) Regulator 230

The regulator 230 regulates the side faces of the sheets S loaded on the loading tray 220 in the width direction orthogonal to the conveyance direction of the sheet S. The regulator 230 includes a plurality of regulators 230 more than one pair and regulates the sheets S from the both sides.

Hereinafter, with reference to FIG. 2, a positional relationship in the conveyance direction will be described. In FIG. 2, the signs of "P1" and "P2" are given to the respective standard positions for convenience of description. "P1" shows the position of the registration roller pair 133. "P2" shows the position of the downstream end of the regulator 230.

As shown in FIG. 2, a length from the position P1 of the registration roller pair 133 to the position P2 of the downstream end of the regulator 230 is set to a prescribed length X, and in this embodiment, a sheet with a length equal to or longer than the prescribed length X is called a "longer sheet". Therefore, in the case of correcting the skew of the longer sheet, the trailing end of the long sheet reaches the position P2 of the downstream end of the regulator 230.

(3-4) Pickup Roller 241

The pickup roller 241 feeds out the sheet S loaded on the loading tray 220. The height of the uppermost sheet S of the loaded sheet bundle is detected by a sensor, and the height of the loading tray 220 is adjusted in response to the detection signal by a lifter so as to become a prescribed height (any one is not shown). Accordingly, as shown in FIG. 1, the pickup roller 241 is arranged so as to come in press contact with the uppermost sheet S loaded on the loading tray 220 with a predetermined pressure. The pickup roller 241 has a structure movable within a predetermined range according to the position of the loading tray 220 and the number of sheets S loaded on the loading tray 220. Accordingly, the pickup roller 241 comes in press contact with the sheet S with a fixed tension regardless of the position of the uppermost sheet S. When the pickup roller 241 rotates, by cooperating with the separator 242, the uppermost sheet S is fed out from the upper portion of the loading tray 220 to the conveyance passage 300 (sheet feeding).

(3-5) Separator 242

The separator 242 separates the uppermost sheet S from the second sheet S loaded on the loading tray 220. In the separator 242, a roller system to separate the sheet S with paired rollers, or an air system to separate the sheet S by spraying air may be adopted. In the present embodiment, the roller system is adopted, and the separator 242 includes a sheet feeding roller 242*a* and a separating roller 242*b* that form one pair of rollers. The sheet feeding roller 242*a* rotates in a normal direction (a clockwise direction in FIG. 3), and the separating roller 242*b* rotates in a reverse direction. The conveying force of the sheet feeding roller 242*a* is set to become stronger than the conveying force of the separating roller 242*b* with a torque limiter.

The sheet feeding roller 242*a* conveys the sheet S fed out from the pickup roller 241 in the direction toward the conveying roller pair 244. On the other hand, the separating roller 242*b* is brought in press contact with the sheet feeding roller 242*a*, and in the case where two or more sheets are fed out from the pickup roller 241 (double feed), the separating roller 242*b* separates second and subsequent lower sheets from the first upper sheet so as to prevent double feed. The pickup roller 241 and the separator 242 function as a sheet feeder.

(3-6) Conveying Roller Pairs 244 and 245

As shown in FIG. 1, each of the conveying roller pairs 244 and 245 includes paired conveying rollers. The conveying roller pair 245 is a conveying roller pair disposed on the most downstream side among a plurality of conveying roller pairs disposed on the conveyance passage 300 of the sheet feeding apparatus 200, and the conveying roller pair 244 is disposed on the one-stage upstream side of the conveying roller pair 245. The sheet S conveyed by the conveying roller pair 245 to the conveyance passage 300 is output to the image forming apparatus body 100 on the downstream side. The loop accommodator 260 is disposed between the conveying roller pair 244 and the conveying roller pair 245. In the below description, the conveying roller pair 244 disposed on the inlet side of the loop accommodator 260 is also referred as an entrance roller pair 244, and the conveying roller pair 245 disposed on the outlet side is also referred as an exit roller pair 245.

(3-7) Sensors 251 to 253

Each of the sensors 251 to 253 detects the end (the leading end and the trailing end), in the sub-scanning direction, of the sheet S conveyed on the conveyance passage 300. For example, each of the sensors 251 to 253 includes a photosensor. The sensor 251 is disposed at a predetermined position immediately after the separator 242 (for example, a position located on the downstream side by several centimeters than the sheet feeding roller 242*a*). The sensor 252 is disposed at a predetermined position immediately after the entrance roller pair 244 (for example, a position located on the downstream side by several centimeters than the entrance roller pair 244). The sensor 253 is disposed at a predetermined position immediately after the exit roller pair 245 (for example, a position located on the downstream side by several centimeters than the exit roller pair 245). In the below description, the sensors 252 and 253 are also referred to as an entrance sensor 252 and an exit sensor 253, respectively.

(3-8) Loop Accommodator 260

In the embodiment shown in FIGS. 1 to 3, the loop accommodator 260 is disposed on the immediately upstream side of the exit roller pair 245. The exit roller pair 245 is disposed on the most downstream side among the conveying roller pairs on the conveyance passage 300 of the sheet feeding apparatus 200. However, without being restricted to this arrangement, the placement position of the loop accommodator 260 may be located at any position on the upstream side than the loop roller pair 132 within the conveyance passage 300, and may be located even in the image forming apparatus body 100.

The loop accommodator 260 includes a pair of an upper guide plate 261 and a lower guide plate 262 that face each other across a conveyance path of the conveyance passage 300 on which a sheet passes. The lower guide plate 262 being one of the pair is connected to a guide plate lifter 281, and moves from an upper position to a lower position (an arrow direction in FIG. 3) or from a lower position to an upper position with a driving motor and a driving transmitter (neither is illustrated) of the guide plate lifter 281.

FIG. 4 is an illustration showing a state where the lower guide plate 262 has been moved to a lower position. Hereinafter, the state of the lower guide plate 262 shown in FIG. 4 is called an "opened state", and the state shown in FIG. 3 is called a "closed state."

In the case where conveyance trouble such as jam has occurred in the vicinity of a boundary of devices in the image forming apparatus body 100 or the sheet feeding apparatus 200, a space 400 shown in FIG. 4 etc. is a space used for removing causal sheets having caused the conveyance trouble. In the case of conveyance trouble, a user opens a front panel of the sheet feeding apparatus 200, and then, can process causal sheets in the sheet feeding apparatus 200 through the space 400. Furthermore, in the case where a user removes causal sheets in the image forming apparatus body 100 (including not-shown trays and passages), the space 400 enables the user to remove the causal sheets by opening a side panel of the image forming apparatus body 100 without releasing the connection between the image forming apparatus body 100 and the sheet feeding apparatus 200.

In the opened state shown in FIG. 4, a space 401 caused by the movement of the lower guide plate 262 is used to accommodate a loop of the sheet S formed between the exit roller pair 245 and the entrance roller pair 244. This loop is also called slack, and hereafter, a loop formed in this loop accommodator 260 is also referred to as a "second loop". Moreover, this space 401 is included (used in common) in the space 400 used for removing causal sheets mentioned above.

The embodiment shown in FIG. 3 etc. shows an example in which the lower guide plate 262 is moved in parallel toward a lower position. However, the constitution should not be limited the above example. For example, the space 401 may be formed with the following constitution. That is, one end of the both ends of the lower guide plate 262 in the conveyance direction is set to an axis center, and the other end of the lower guide plate 262 is turned around the axis center so as to open and close. Accordingly, the other end of the lower guide plate 262 is separated from the upper guide plate 261 so as to form the space 401, and the space 401 can be used to accommodate the second loop of the sheet S. Moreover, conversely, the space 401 to accommodate the second loop may be secured with the constitution that the lower guide plate 262 is fixed and the upper guide plate 261 is moved to an upper position.

(3-9) Communicator 270

The communicator 270 is an interface for communicating with the image forming apparatus body 100. The communicator 270 transmits and receives various setting values and various kinds of information required for operation timing control, etc. with the image forming apparatus body 100.

(3-10) Press-Contact Releaser 282

As shown in FIG. 3, the press-contact releaser 282 is connected to the exit roller pair 245. The press-contact releaser 282 includes a driving transmitter including a driving motor, a cam, etc. (any one is not illustrated). An upper roller 245*a* of the exit roller pair 245 has a fixed shaft, a lower roller 245*b* has a movable shaft, and both the rollers are biased toward each other with a prescribed pressure via an elastic member such as a spring. By actuating the press-contact releaser 282, the rotation shaft of the lower roller 245*b* moves downward, so that the lower roller 245*b* becomes a separation state of being not in contact with the upper roller 245*a*.

FIG. 3 shows an example where the press-contact releaser 282 is connected to the exit roller pair 245 located on the immediately downstream side of the loop accommodator 260. However, in place of the above arrangement, or together with the above arrangement, the press-contact releaser 282 may be connected to other conveying roller pairs disposed between the loop accommodator 260 and the registration roller pair 133. For example, the press-contact releaser 282 may be connected to each of the exit roller pair 245 and the conveying roller pairs 131 and 132.

[Operation of the Image Forming Apparatus 10] Next, the characteristic operation of the image forming apparatus 10 is described.

(1) Print Processing

Figure 5:
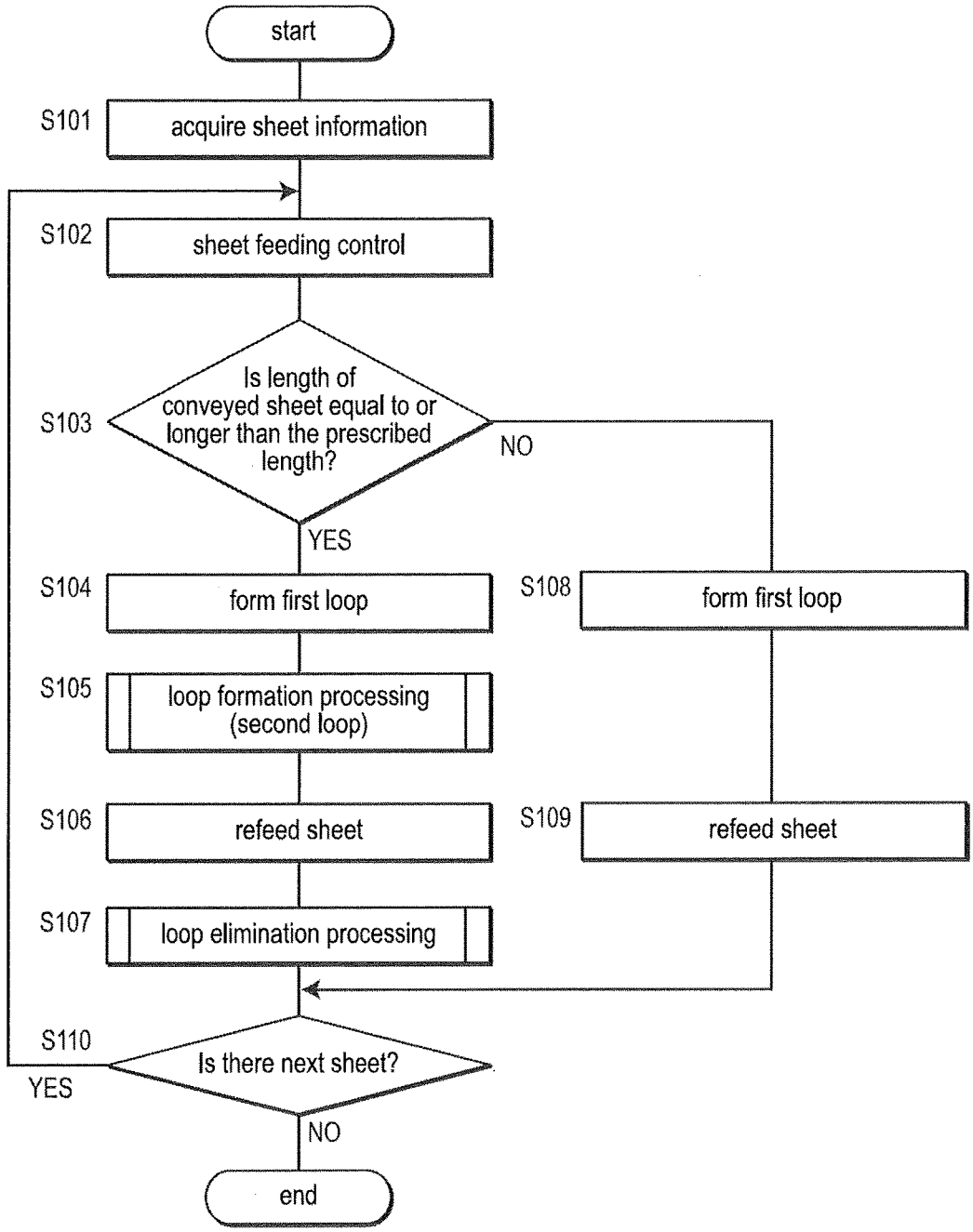
FIG. 5 is a flowchart of print processing.
Figure 6:
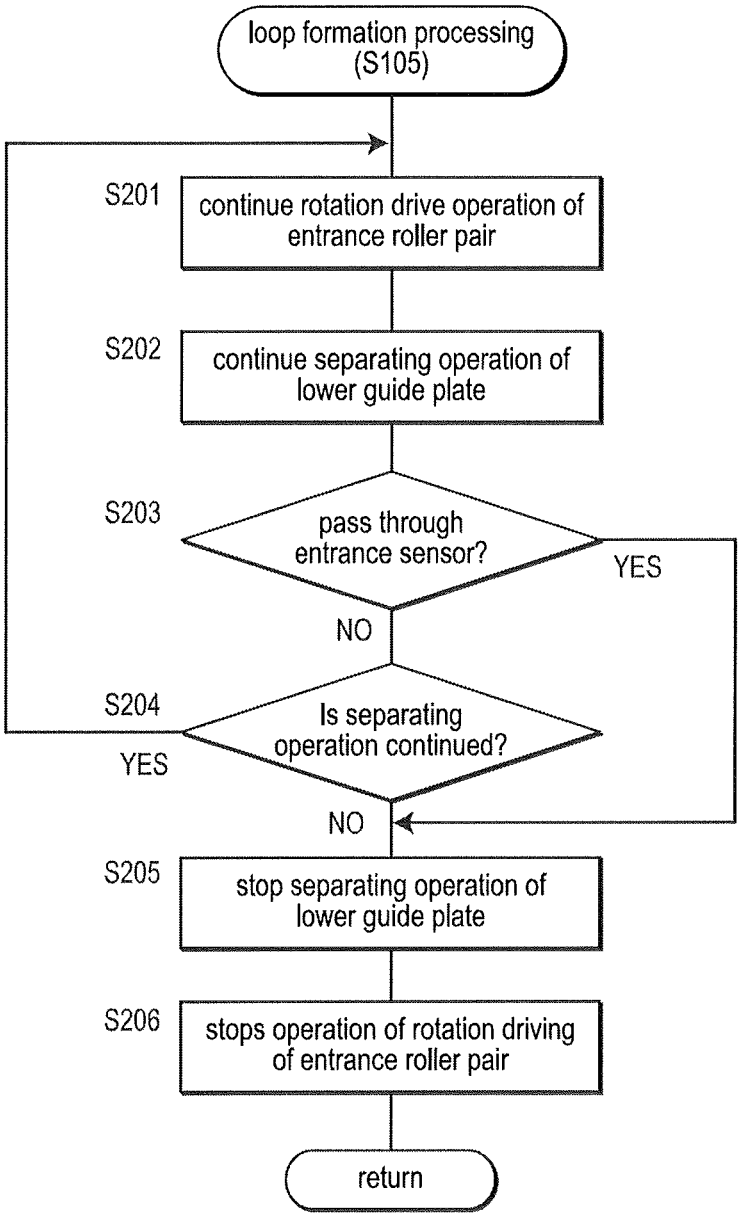
FIG. 6 is a flowchart showing a subroutine.
Figure 7:
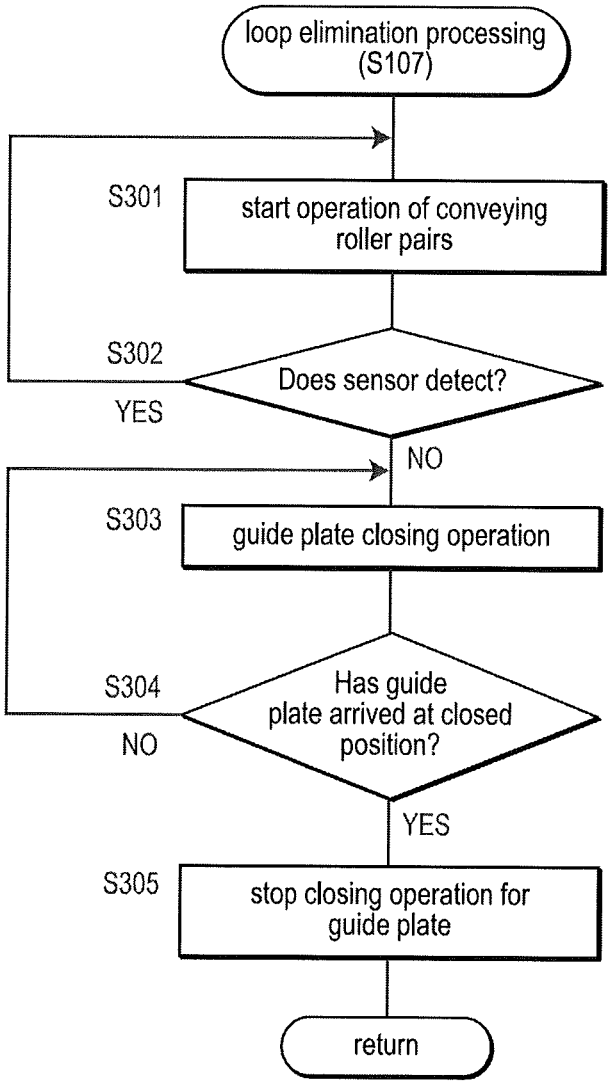
FIG. 7 is a flowchart showing a subroutine.

FIGS. 5 to 7 are the flow charts of print processing executed cooperatively by the processor 110 and the processor 210. FIGS. 8A to 8D are illustrations showing the conveyance state of the sheet S of the image forming apparatus 10 during the print processing. The processor 110 of the image forming apparatus body 100 starts print processing when receiving an instruction of a copy through the touch panel 120 from a user, or when receiving a print job from other apparatuses. When print processing is started, the processor 110 transmits signals to instruct the start of printing to the sheet feeding apparatus 200 through the communicator 170.

(Step S101)

Then, the processor 110 acquires the sheet information with respect to the sheet S of a printing object.

For example, in the case of starting print processing upon receipt of an instruction of a copy, the processor 110 specifies the designation with regard to a sheet size (B5, A4, A3, etc.) and a sheet type (selection of thicker sheet/thin sheet, basis weight input, etc.) that have been received through the touch panel 120 together with the instruction of the copy. In addition, in the case of designating a non-registered sheet size (long sheet etc.), it is necessary to designate at least a length in a conveyance direction.

Moreover, in the case of starting print processing upon receipt of a print job, the processor 110 specifies the designation with regard to a sheet size (or a length in a conveyance direction) and a sheet type with reference to the setting information (a job ticket) included in the print job.

Subsequently, the processor 110 transmits the setting values with respect to the sheet size and the sheet type each designated by the user to the sheet feeding apparatus 200 through the communicator 170.

The processor 210 of the sheet feeding apparatus 200 receives the setting values with respect to the sheet size and the sheet type through the communicator 270 and registers (memorizes) them as sheet information in a memory and the like.

(Step S102)

The processor 210 of the sheet feeding apparatus 200 executes sheet feeding control. In concrete terms, in the case where the loading tray 220 is not located at a sheet feeding position, the processor 210 performs a lifting operation so as to locate the loading tray 220 at the sheet feeding position, and thereafter, the processor 210 rotates the pickup roller 241 so as to feed out the uppermost sheet S on the loading tray 220 toward the sheet feeding roller 242*a*. At this time, the processor 210 rotates each of the sheet feeding roller 242*a*, the entrance roller pair 244, and the exit roller pair 245 so as to convey the sheet S on the conveyance passage 300.

Figure 8A:
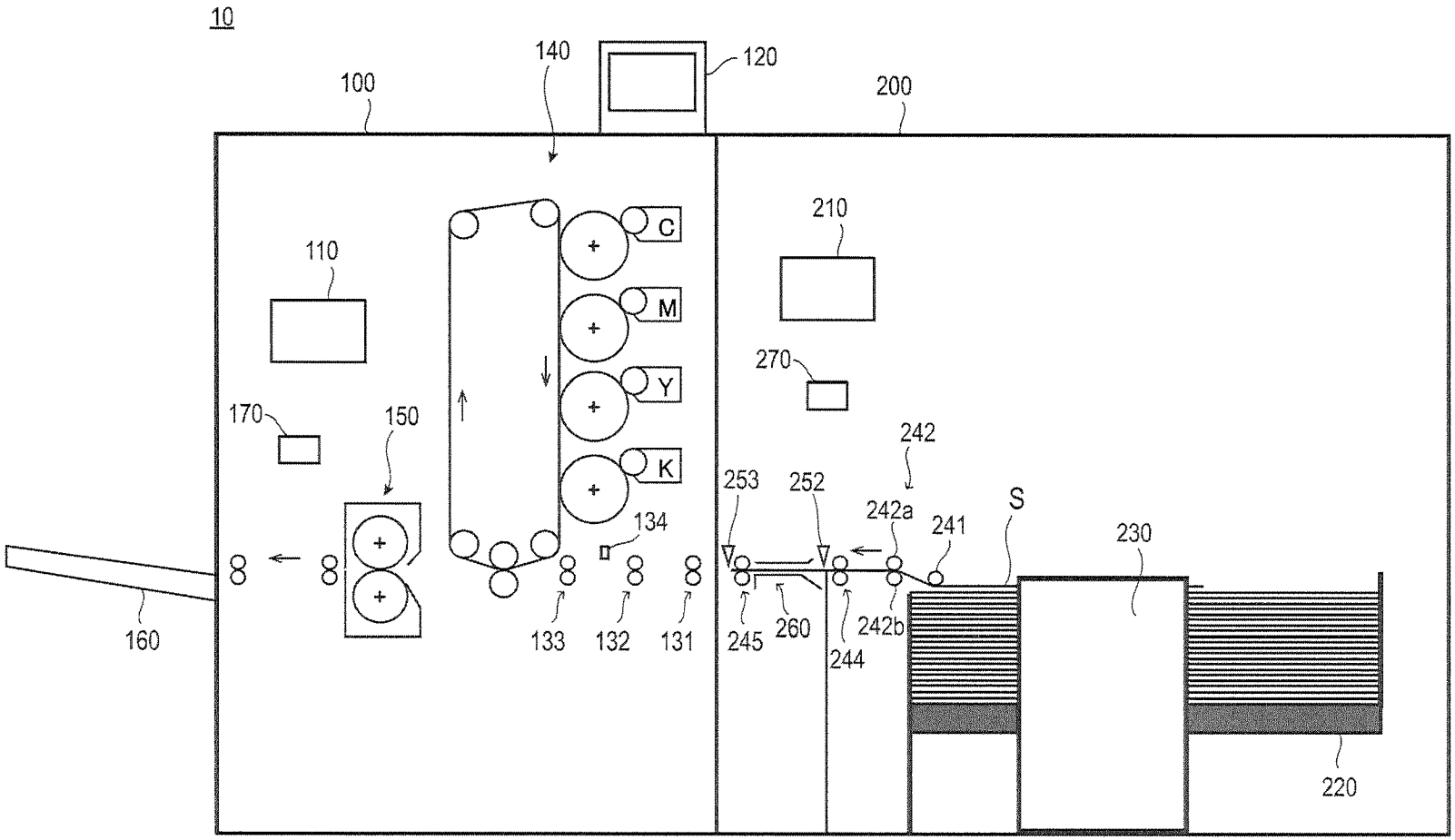
FIG. 8A is an illustration showing a conveyance state of a sheet within a conveyance passage in Step S102.

FIG. 8A is an illustration showing the conveyance state of the sheet S within the conveyance passage 300 in Step S102, and, in FIG. 8A, the leading end of the sheet S has reached the exit roller pair 245.

Moreover, along with the start of sheet feeding, the processor 210 transmits signals to notify the situation that the sheet feeding has been started, to the image forming apparatus body 100 through the communicator 270. The processor 110 that has received the above signals through the communicator 170 rotates each of the conveying roller pairs 131 and 132 so as to convey the sheet S output from the sheet feeding apparatus 200 until the leading end of the sheet S reaches the registration roller pair 133.

(Step S103)

The processor 210 determines whether the length of the conveyed sheet S in the conveyance direction is equal to or longer than the prescribed length X. Here, as mentioned above, the prescribed length X is a length in the conveyance direction from the position P1 of the registration roller pair 133 serving as the skew corrector to the position P2 of the downstream end of the regulator 230.

In the case where the processor 210 determines that the length is equal to or longer than the prescribed length X (Step S103: YES), the processor 210 advances the processing to Step S104. On the other hand, in the case where the processor 210 determines that the length is not equal to or longer than the prescribed length X (Step S103: NO), the processor 210 advances the processing to Step S108.

(Step S104)

The processor 110 rotates each of the conveying roller pairs 131 and 132 in accordance with the timing at which the feeding of the sheet S has been started in Step S102. At this time, the registration roller pair 133 is in a stopped state.

Even after the leading end of the sheet S has reached the registration roller pair 133 being in the stopped state, has come in contact with the registration roller pair 133, and has stopped, the processors 110 and 210 continuously drive and rotate each of the loop roller pair 132 and the conveying roller pairs located on the upstream side than the loop roller pair 132 for a predetermined time. With this, the first loop is formed on the sheet S between the registration roller pair 133 and the loop roller pair 132. At this time, the leading end of the sheet S becomes parallel to the axial direction of the registration roller pair 133.

Figure 8B:
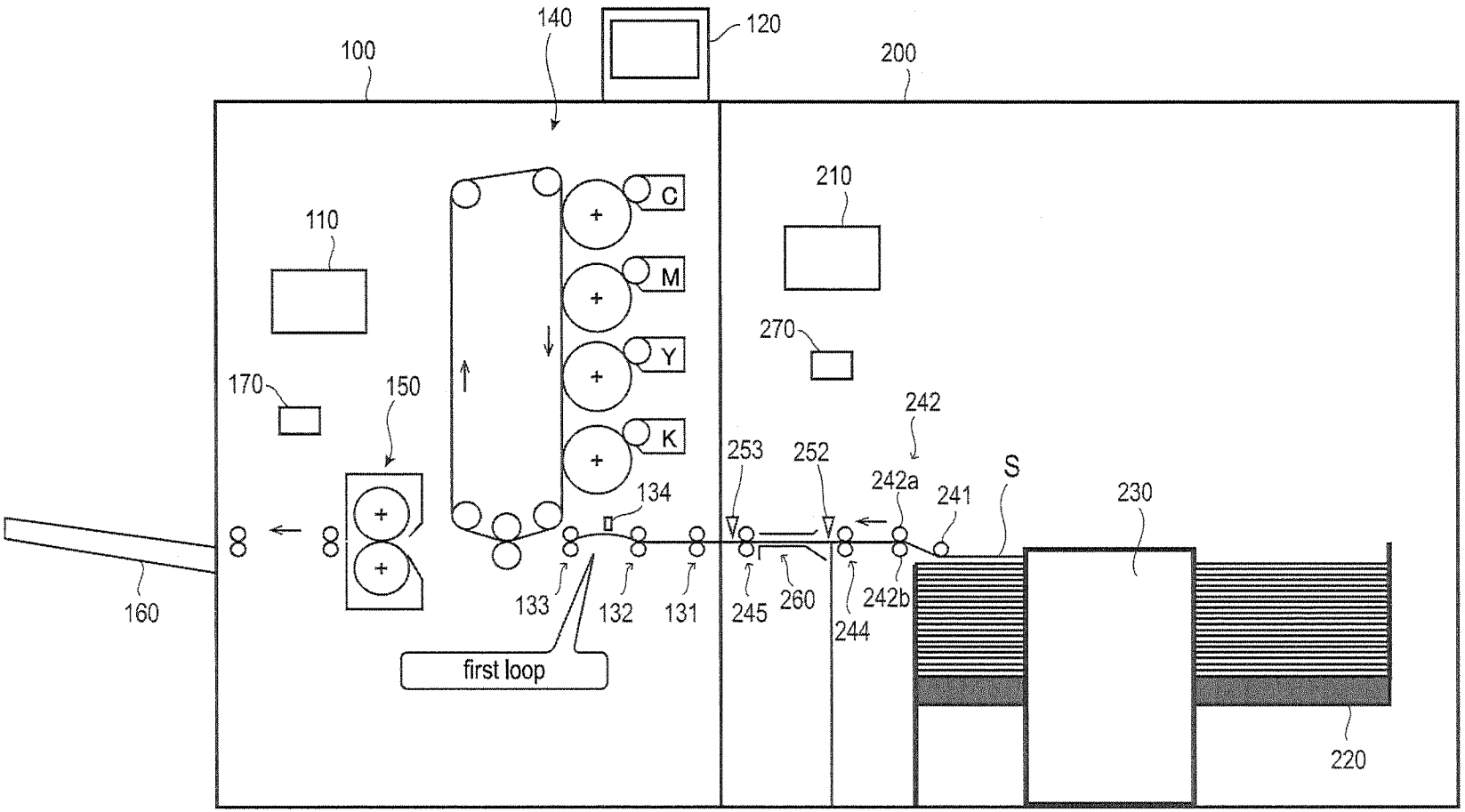
FIG. 8B is an illustration showing a conveyance state of a sheet within a conveyance passage in Step S104.

FIG. 8B is an illustration showing the conveyance state of the sheet S within the conveyance passage 300 in Step S104, as shown in FIG. 8B, the leading end of the sheet S comes in contact with the registration roller pair 133, and, the first loop is formed between the registration roller pair 133 and the loop roller pairs 132. Each of the conveying roller pairs located on the upstream side than the loop roller pair 132 is driven and rotated at the same line speed until the conveyance state becomes the above state. After the first loop has been formed, each of the conveying roller pairs located on the downstream side than the loop accommodator 260 is made to stop. Immediately after the conveyance state has become that shown in FIG. 8B, each of the conveying roller pairs 245, 131, 132, and 133 is made to stop.

(Step S105)

Subsequently, the processors 110 and 210 execute loop formation processing to form a second loop in the loop accommodator 260 by controlling the rotation driving of each of the conveying roller pairs as described below.

FIG. 6 is a flowchart showing the subroutine of loop formation processing (S105).

(S201)

In the state where the exit roller pair 245 is made to stop, the processor 210 continues the rotation drive operation of the entrance roller pair 244. At this time, each of the conveying roller pairs being conveying the sheet S on the upstream side than the entrance roller pair 244 is also continuing the operation of the rotation driving. With this, a loop is started to be formed in the loop accommodator 260.

(S202)

Next, a separating operation of the lower guide plate 262 is performed. This separating operation is performed such that the processor 210 controls the guide plate lifter 281 so as to move the lower guide plate 262 downward and to separate the lower guide plate 262 from the upper guide plate 261. Furthermore, the operation to move the lower guide plate 262 downward is continued. The start timing of the separating operation for the lower guide plate is before Step S201, more preferably at a timing after the leading end of the sheet S has passed the lower guide plate 262 and before Step S104.

(S203)

The processor 210 determines whether the trailing end of the sheet S has passed through the detection position of the entrance sensor 252 (hereinafter, simply called "pass through the entrance sensor 252" (the same for the exit sensor 253 etc.)). In the case of "pass through the entrance sensor 252" (Step S203: YES), processing is advanced to Step S205. On the other hand, in the case of "not pass through the entrance sensor 252", processing is advanced to Step S204.

(S204)

The processor 210 determines whether the operation to move the lower guide plate 262 downward is to be continued. In any one of the case (1) where the lower guide plate 262 reaches the lower limit position within the operation range of the guide plate lifter 281, the case (2) where the amount of the second loop exceeds a predetermined conveyance length, and the case (3) where the processor 110 has started the sheet refeeding of the registration roller pair 133, the processor 210 determines that the operation is not to be continued. The case (1) may be determined such that, for example, a lower limit sensor is disposed so as to detect that the lower guide plate 262 has reached the lower limit position, and the determination is made based on the output of the lower limit sensor. The cases (1) and (2) may be determined based on an operation amount (operation time) of the guide plate lifter 281.

In the case of continuing the operation (S204: YES), the processing is returned to Step S201, and each processing is repeated. On the other hand, in the case of not continuing the operation (S204: NO), the processing is advanced to S205.

(S205)

The processor 210 controls the guide plate lifter 281 so as to stop the separating operation of the lower guide plate 262.

(S206)

Subsequently, the processor 210 stops the operation of the rotation driving of the entrance roller pair 244. With the above processing, the subroutine processing is ended, and the processing is returned to the processing shown in FIG. 5.

Figure 8C:
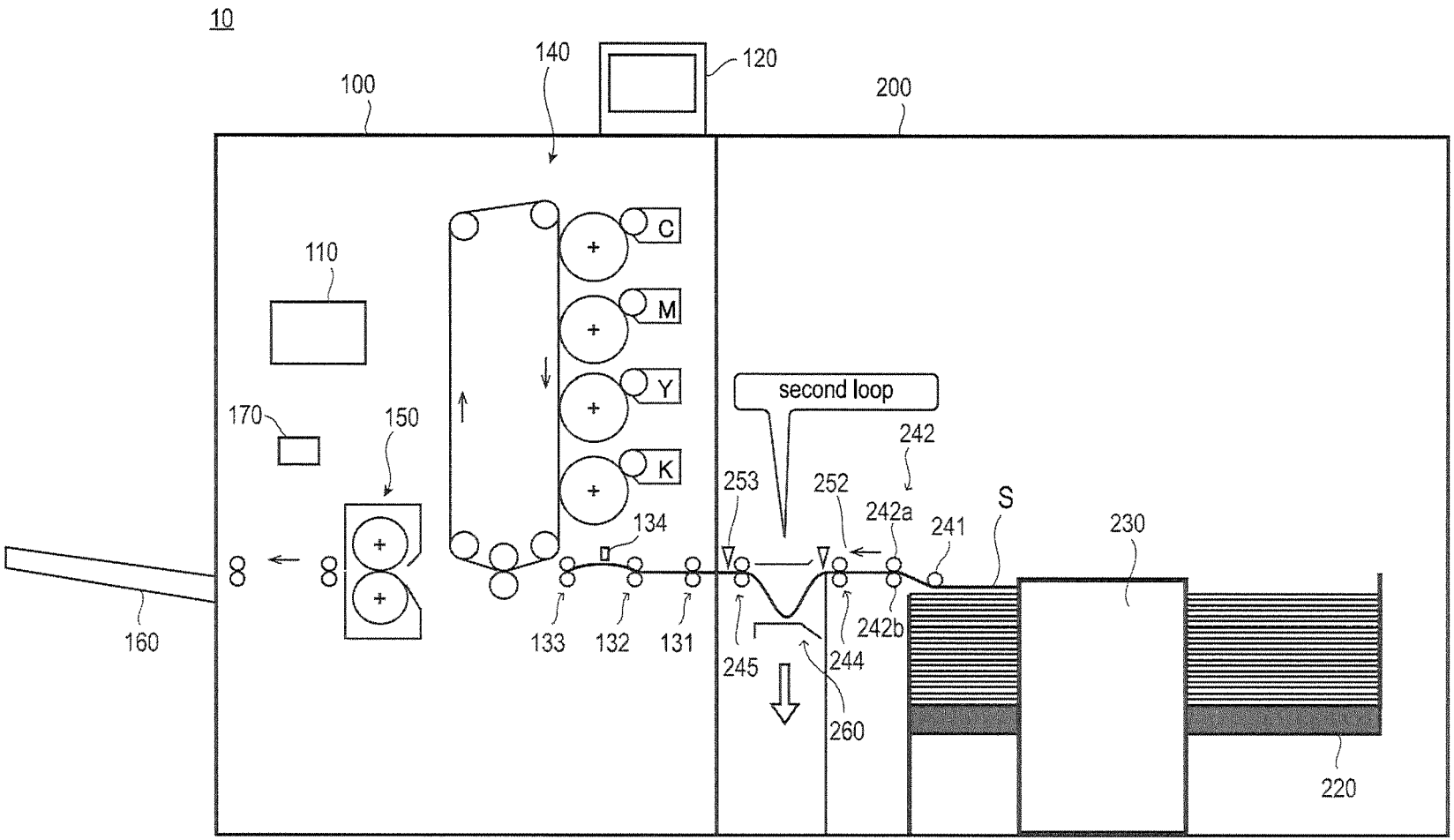
FIG. 8C is an illustration showing a conveyance state of a sheet within a conveyance passage in Step S105.

FIG. 8C is an illustration showing the conveyance state of the sheet S within the conveyance passage 300 in Step S105. As shown in FIG. 8C, in the loop accommodator 260, the lower guide plate 262 is moved downward and separated from the upper guide plate 261, whereby the space 401 (refer to FIG. 4) to allow a loop to be formed is secured. Then, the second loop is formed in the space 401.

(Step S106)

Subsequently, the processor 110 refeeds the sheet S in synchronization with the timing of image formation. In concrete terms, the processor 110 drives and rotates each of the registration roller pair 133 and the conveying roller pairs located on the upstream side than the registration roller pair 133. With this, the sheet S is conveyed to the transfer position of the image former 140 while the whole sheet S is being corrected.

(Step S107)

Subsequently, the processors 110 and 210 execute loop elimination processing to eliminate the second loop formed in the loop accommodator 260 by controlling the rotation driving of each of the conveying roller pairs as described below.

FIG. 7 is a flowchart showing the subroutine of loop elimination processing (S107).

(S301)

The processors 110 and 210 starts the operation of the conveying roller pairs pinching the sheet S such as the entrance roller pair 244, the exit roller pair 245 and the like so as to convey the sheet S.

(S302)

The processor 210 determines whether the entrance sensor 252 is detecting the sheet S. In the case where the entrance sensor 252 is detecting the sheet S (Step S302: YES), the processing is returned to Step S301. On the other hand, in the case where the sheet S has already passed through the detection position of the entrance sensor 252, or in the case where the output of the entrance sensor 252 is switched to OFF due to having passed, the processor 210 determines that the entrance sensor 252 does not detect the sheet S (Step S302: NO), and advances the processing to Step S303.

(S303)

The processor 210 performs a guide plate closing operation. In concrete terms, the processor 210 actuates the guide plate lifter 281 so as to move the lower guide plate 262 upward.

(S304)

Then, the processor 210 determines whether the lower guide plate 262 has arrived at the closed position, i.e., the upper limit position of the operation range. In the case of not having arrived at the closed position (Step S304: NO), the processing is returned to Step S303. On the other hand, in the case of having arrived at the closed position (Step S305: YES), the processing is advanced to Step S305.

(S305)

The processor 210 controls the guide plate lifter 281 so as to stop the operation for the lower guide plate 262. With the above processing, the subroutine processing is ended, and the processing is returned to the processing shown in FIG. 5, and the processing is advanced to Step S110.

Figure 8D:
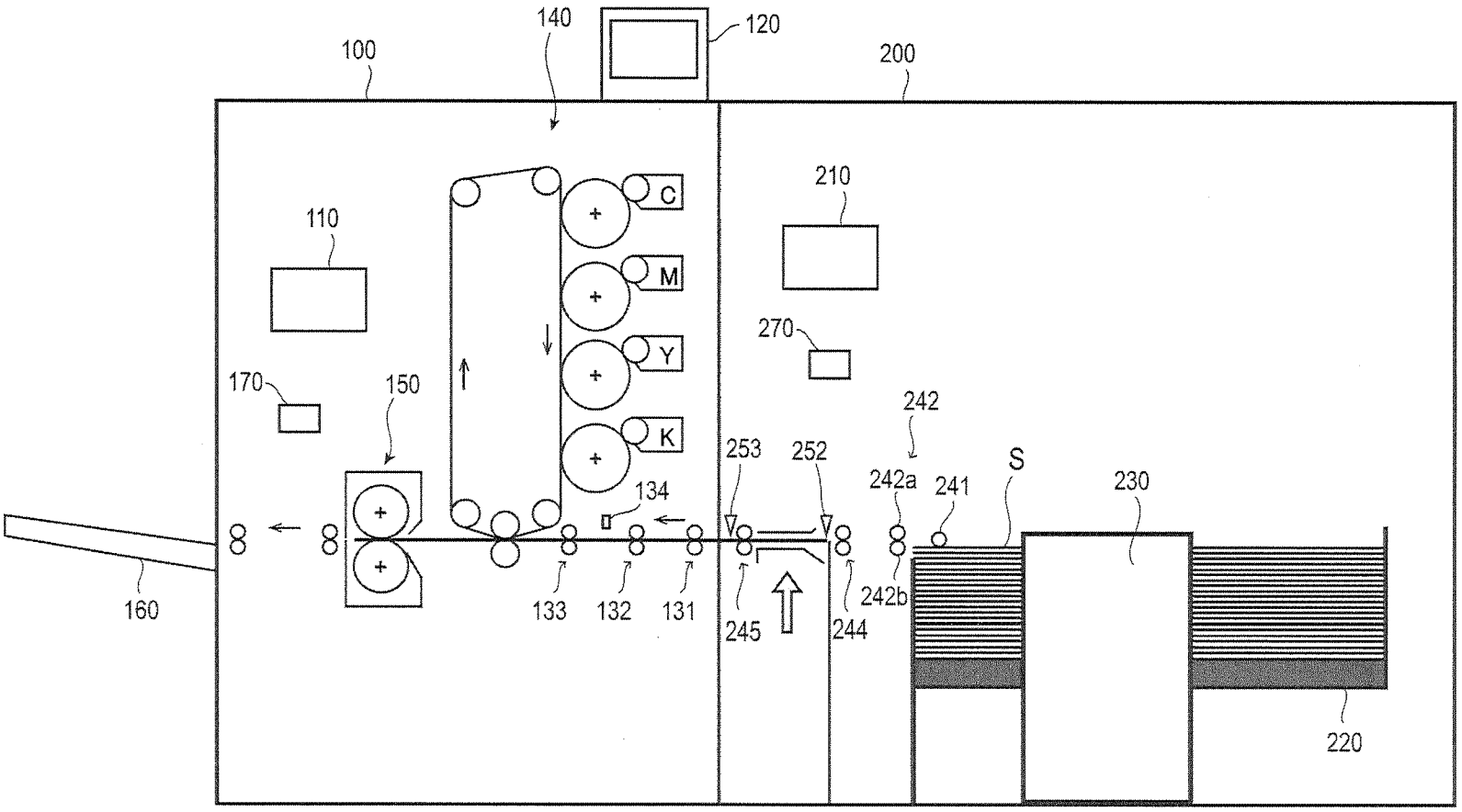
FIG. 8D is an illustration showing a conveyance state of a sheet within a conveyance passage in Step S107.

FIG. 8D is an illustration showing the conveyance state of the sheet S within the conveyance passage 300 in Step S107. As shown in FIG. 8D, the sheet S is refed, and the first and second loops are eliminated. Moreover, the lower guide plate 262 has returned to the closed state before the following sheet S is conveyed.

(Step S108)

Here, in the case where the processing shifts from Step S103 to Step S108, the processors 110 and 210 form the first loop with the same control as in Step S104. In concrete terms, after the leading end of the sheet S has reached the registration roller pair 133 being in the stopped state, has come in contact with the registration roller pair 133, and has stopped, the processors 110 and 210 continuously drive and rotate each of the loop roller pair 132 and the conveying roller pairs located on the upstream side than the loop roller pair 132 for a predetermined time. With this, the first loop is formed on the sheet S between the registration roller pair 133 and the loop roller pair 132. At this time, the leading end of the sheet S becomes parallel to the axial direction of the registration roller pair 133.

(Step S109)

Subsequently, by the same control as in Step S106, the processor 110 performs sheet refeeding in synchronization with image formation timing. In concrete terms, the processor 110 drives and rotates each of the registration roller pair 133 and the conveying roller pairs located on the upstream side than the registration roller pair 133. With this, the sheet S is conveyed to the transfer position of the image former 140 while the whole sheet S is being corrected. Thereafter, the processing is advanced to Step S110.

(S110)

The processors 110 and 210 determine whether a new sheet S is to be fed. For example, the control unit 210 determines by referring to the number of uncopied pages or the number of unprinted pages among the total number of pages included in a print job.

In the case where the processor 210 determines that a new sheet S is to be fed (Step S110: YES), the processor 210 returns the processing to Step S102, and newly starts sheet feeding control. On the other hand, in the case where the processor 210 determines that a new sheet S is not to be fed (Step S110: NO), the print processing is ended.

Here, each of the processing units in the above-described flow chart is divided according to the main processing contents in order to make the understanding for the image forming apparatus 10 easy. The present invention is not restricted by the method of dividing processing steps and their names. The processing performed in the image forming apparatus 10 may also be divided into much more processing steps. Moreover, one processing step may perform much more processing.

(2) Control Timing

Figure 9:
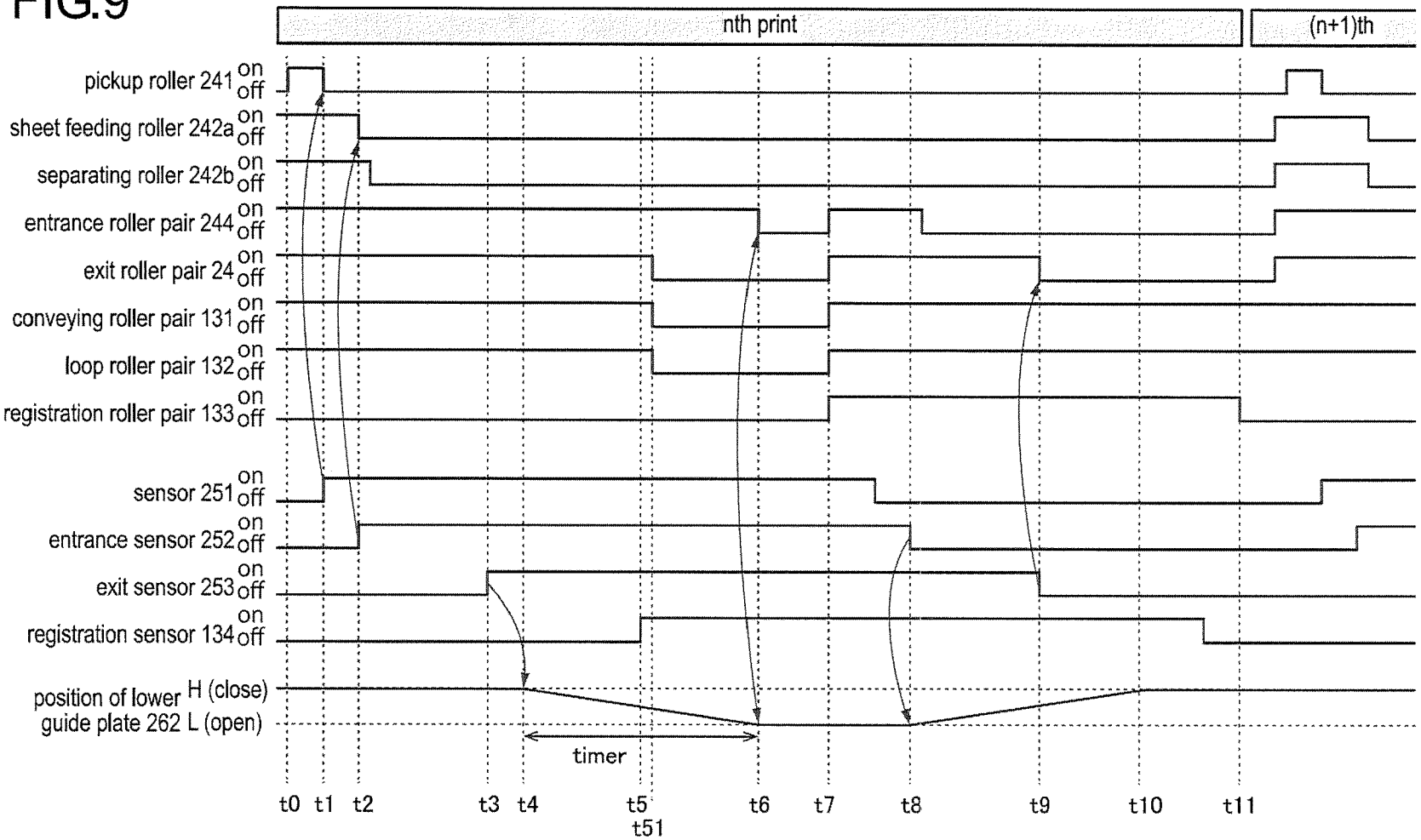
FIG. 9 is a time chart.

Next, with reference to a time chart shown in FIG. 9, description is given to the control timing of each constitution element (each sensor and each conveying roller pair) arranged along the conveyance passage 300. In FIG. 9, the axis of abscissa shows time, and the axis of ordinate shows signal output or operation of each constitution element. In FIG. 9, the first loop is formed between time t5 to time t51, and the second loop is formed between time t51 to time t6. Hereinafter, the description is given.

According to execution of a print job, the processor 110 sends a sheet feed request signal to the processor 210. At time to, the processor 210 turns ON (actuates) the pickup roller 241 in response to a sheet feed request. At this time point, each of conveying roller pairs, such as the sheet feeding roller 242*a*, the separating roller 242*b*, and the entrance roller pair 244 is ON. After the leading end of the sheet S has passed the separator 242 at time t1, and before the leading end reaches the entrance roller pair 244 located on the downstream side than the separator 242, namely, at the timing when the sensor 251 is switched from OFF to ON, the pickup roller 241 is turned OFF.

At time t2, in response to the switching of the entrance sensor 252 to ON, the sheet feeding roller 242*a* is turned OFF.

At time t3, the leading end of the sheet S passes through the loop accommodator 260, in response to this, the exit sensor 253 is switched to ON. At time t4 when a predetermined time has elapsed from time t3, the processor 210 controls the guide plate lifter 281 to start lowering (moving-downward) of the lower guide plate 262 that has been in the "closed state" by that time.

At time t5, the leading end of the conveyed sheet S has reached the registration sensor 134. Thereafter, the leading end of the sheet S comes in contact with the registration roller pair 133 having stopped. During a period from time t5 to time t51, the first loop is formed between the registration roller pair 133 having stopped and the loop roller pair 132 being rotating.

At time 51, each of the loop roller pair 132, the conveying roller pair 131 located on the upstream side than the loop roller pair 132, and the exit roller pair 245 is made to stop. After time 51, the second loop is started to be formed on the conveyance passage 300 between the exit roller pair 245 having stopped and the entrance roller pair 244 keeping rotating, i.e., in the loop accommodator 260. With regard to the moving-downward (separating) of the lower guide plate 262, the separating operation is started between (time t3 to t51), that is, after the leading end of the sheet S has passed through the loop accommodator 260 and before the first loop formation has been completed. That is, at this time, the lower guide plate 262 has already been moving downward, and a space to accommodate the second loop being enlarging is secured between the upper guide plates 261 and the lower guide plate 262.

At time t6, the entrance roller pair 244 is turned OFF. Based on the time interval between time t51 and time t6, the amount of the second loop can be set. The amount of the second loop is set, for example, based on the length between the entrance roller pair 244 and the exit roller pair 245. In concrete terms, in the case where the distance between both the conveying roller pairs is Lx, a period of from time t51 to t6 is set so as to further convey the sheet S with the length of Lx to accommodate the sheet S with a length being two times the distance Lx between both the conveying roller pairs. Moreover, at time t6, a predetermined time has elapsed from time t4. Accordingly, the moving-downward of the lower guide plate 262 is made to stop, and the rotation of the entrance roller pair 244 is made to stop. In this connection, as described in FIG. 6, without determining the above stop operation based on a factor of the elapsing of the predetermined time, the stop operation may be performed base on another factor that a detection sensor has detected that the lower guide plate 262 has reached the lower limit position, or based on still another factor that the trailing end of the sheet S has passed through the sensor 251.

After that, at time t7, in synchronization with an image formation timing, the processors 110 and 210 turn ON simultaneously a plurality of conveying roller pairs 131 to 133, 244, and 245, and refeed the sheet S (equivalent to Steps S106 and S301 in FIG. 5).

At time t8, in response to the situation that the trailing end of the sheet S has passed through the entrance sensor 252, the processor 210 starts the moving-upward of the lower guide plate 262 being the "opened state". This moving-upward is continued until the loop accommodator 260 becomes the "closed state". In the example shown in FIG. 9, the loop accommodator 260 becomes the "closed state" at time t10. However, it is permissible that the loop accommodator 260 becomes the "closed state" before a sheet S conveyed next reaches the lower guide plate 262 (till time t2 in the print for the (n+1)th sheet).

At time t9, in response to the situation that the trailing end of the sheet S has passed through the exit sensor 253, the exit roller pair 245 is turned OFF. At time t11, in response to the situation that the trailing end of the immediately-proceeding sheet S has passed through the registration sensor 134, the registration roller pair 133 is made to stop, and preparation to receive the next sheet S is performed.

The operations performed in the above are the operations of the constitution elements with respect to the conveyance of one sheet at the time of performing printing. In the case of conveying the sheet S continuously, the above operations are repeated.

In this way, in the print processing executed by the image forming apparatus 10 according to the present embodiment, in the case of conveying a long sheet with a length equal to or longer than the prescribed length X, the processors 110 and 210 form the second loop in the loop accommodator 260. With this, the influence of the skew correction performed on the sheet leading end side on the downstream side in the conveyance direction by the registration roller pair 133 is made not to be given to the upstream side than the second loop. In concrete terms, even if a twist arises on the sheet S by the skew correction, its influence is absorbed by the second loop. With this, the twist of a sheet does not influence both the regulation of the regulator 230 for the side faces of the loaded sheets and the skew correction. Accordingly, it becomes possible to prevent sheet trouble caused by the regulation of the regulator 230 while maintaining skew correction with high precision.

Figure 10:
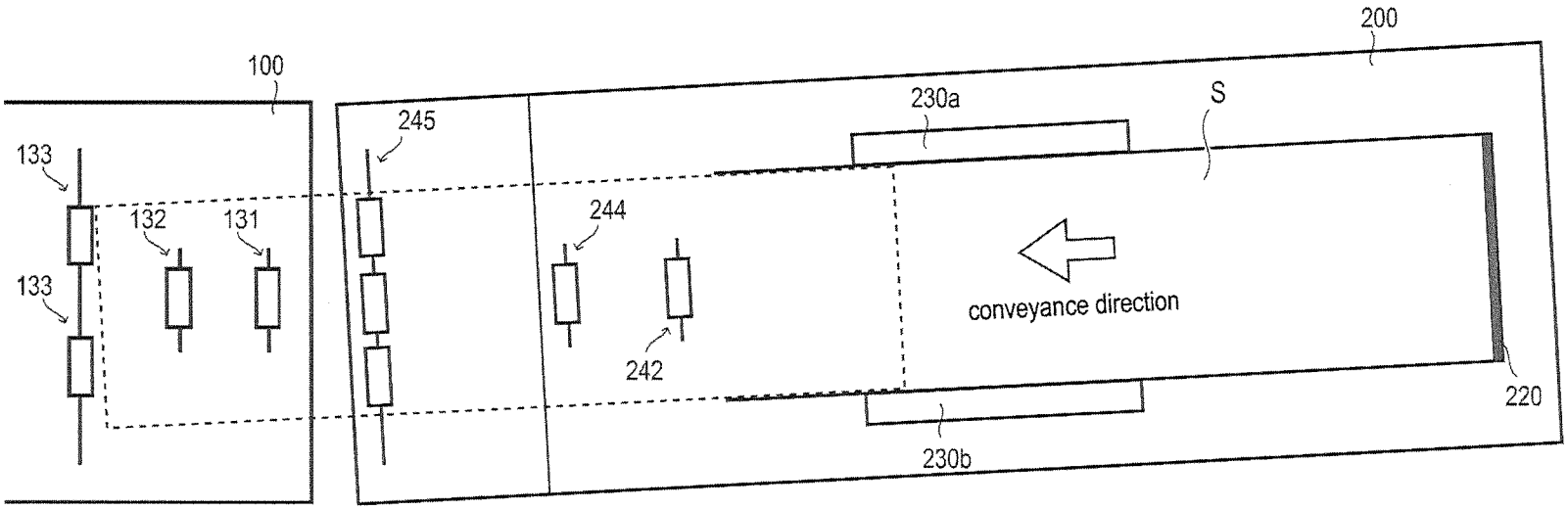
FIG. 10 is an illustration showing a state where a positional relationship between an image forming body and a sheet feeding apparatus is not normal.

FIG. 10 is an illustration in the state where the positional relationship between the image forming apparatus body 100 and the sheet feeding apparatus 200 is not normal. Depending on the installing place of the image forming apparatus body 100 and the sheet feeding apparatus 200, the alignment of the conveyance passage of the sheet S may become out of order like the example shown in FIG. 10. If the alignment becomes out of order, the sheet S may be twisted by skew correction. However, like the present embodiment, in the case where the second loop is formed in the loop accommodator 260, the twist of the sheet S is absorbed by the second loop. Accordingly, the adverse effect by the misalignment does not influence both the regulation of the regulator and the skew correction. In particular, the distortion of the conveyance passage 300 is large in the vicinity of the connecting portion between the apparatuses. Accordingly, it is desirable to arrange the loop accommodator 260 in the vicinity of the connecting portion. In the present embodiment, the loop accommodator 260 is disposed so as to adjoin the immediately upstream side of the exit roller pair 245 located on the most downstream side in the sheet feeding apparatus 200.

Modified Embodiment

Moreover, the above-described embodiment intends to exemplify the gist of the present invention, and does not limit the present invention. Many substitutes, correction, and modification are clear for a person skilled in the art.

For example, in the modified embodiment, along with the creation timing of the second loop, press-contact of the conveying roller pair on the downstream side of the loop accommodator 260 is released. Hereinafter, the modified embodiment is described with reference to a time chart executed by the image forming apparatus 10 according to the modified embodiment shown in FIG. 11.

Figure 11:
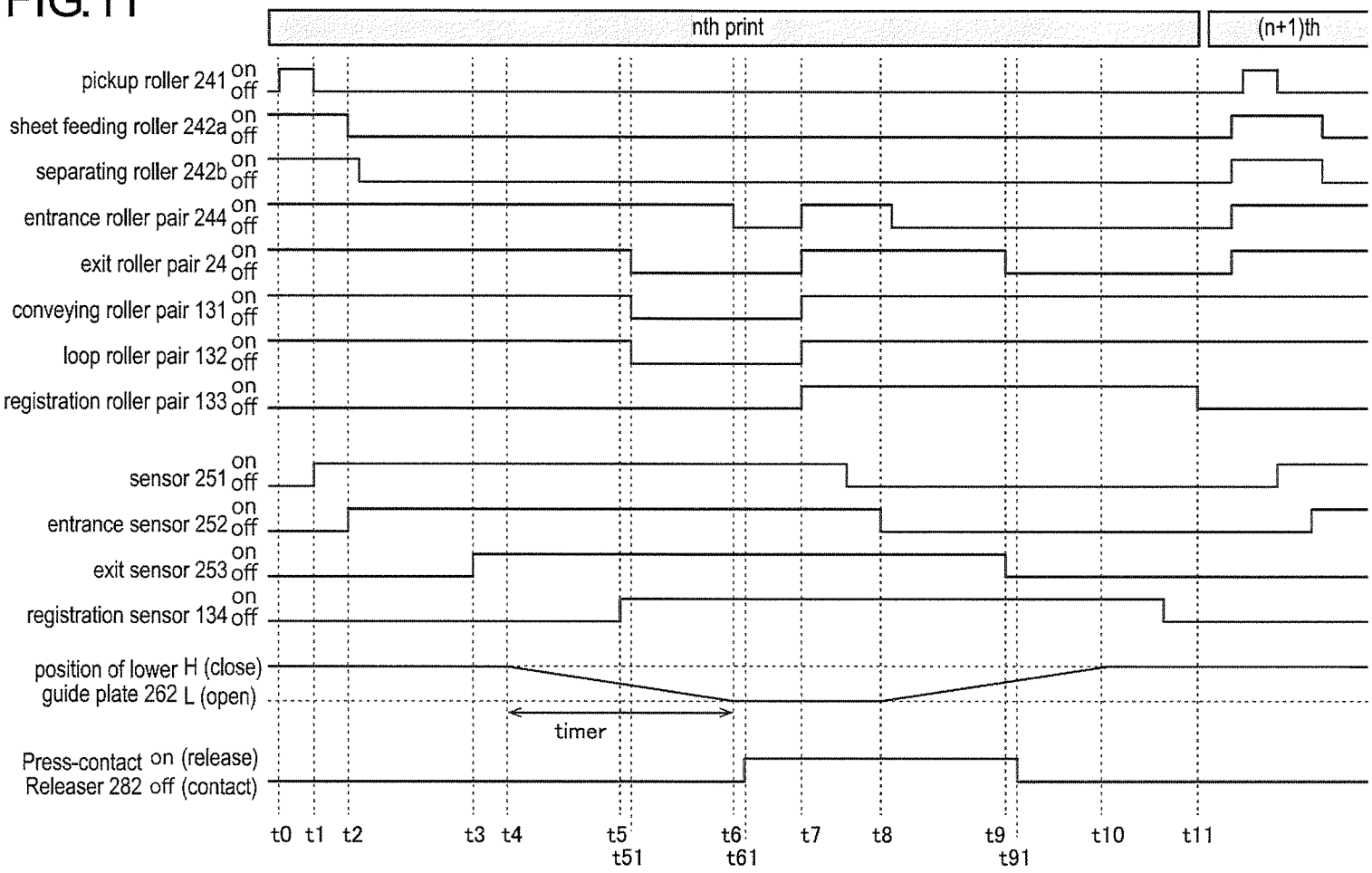
FIG. 11 is a time chart according to a modified embodiment.

In the time chart shown in FIG. 11, the operation timing of the press-contact releaser 282 is added to the time chart shown in FIG. 9. Other than that, the operation timing is the same as that in FIG. 9. Accordingly, description for the common portion is omitted.

In FIG. 11, the second loop of the sheet S is formed in the loop accommodator 260 during a period from time t51 to time t6. Subsequently, at time t61, the press-contact releaser 282 is actuated so as to release the press-contact of the exit roller pair 245 on the downstream side than the position at which the second loop has been formed. Furthermore, this released state is canceled at a timing after the trailing end of the sheet S has passed through the exit sensor 253 and before the leading end of a sheet conveyed next has reached the exit roller pair 245, for example, at time t91 immediately after the sheet S has passed through the exit sensor 253, and then the exit roller pair 245 returns to the press-contact state.

In the modified embodiment, with such an operation, even if alignment is out of order in the vicinity of the connecting portion of the apparatuses (for example, refer to FIG. 10), by releasing the press-contact of the exit roller pair 245, a distance between conveying roller pairs to pinch the sheet S is made longer. In concrete terms, the conveying roller pairs that pinch the sheet S across the connecting portion with the possibility that misalignment is caused, become the conveying roller pair 244 and the conveying roller pair 131 so that the conveyance passage between them becomes longer. Furthermore, the second loop is formed at this position. Accordingly, with this second loop, the length of the sheet S existing between the conveying roller pair 244 and the conveying roller pair 131 becomes longer. By doing in this way, even if a twist is caused in each of the leading end side and trailing end side of the sheet S by the skew correction, its influence is absorbed by the sheet S that exists in the state of being slack between the conveying roller pair 244 and the conveying roller pair 131, and the twist does not affect both the upstream side and downstream side. That is, a twist of the sheet caused by skew correction does not affect both the regulation of the regulator for the side faces of the loaded sheets and the skew correction.

The present embodiment shows an example in which one conveying roller pair is released by the press-contact releaser 282. However, the present embodiment should not be restricted to this example. For example, all the conveying roller pairs 245, 131, and 132 disposed between the loop accommodator 260 and the registration roller pair 133 may be released, or some of them may be released. With this, the length of the sheet S between the conveying roller pairs pinching the sheet S across the connecting portion can be made longer, whereby the influence of a twist of the sheet S due to skew correction can be reduced more.

Another Modified Embodiment

The present embodiment shows an example in which the image forming apparatus body 100 and the sheet feeding apparatus 200 are made as the respective separate apparatuses, and are connected to each other. However, the present embodiment should not be restricted to this example. The sheet feeding apparatus 200 may be incorporated in the image forming apparatus body 100. With this, there is no need to install the sheet feeding apparatus 200, and space saving can be attained. Moreover, various post processing apparatuses may be further connected to the image forming apparatus body 100.

Moreover, in the case where the image forming apparatus 10 is constituted such that the sheet feeding apparatus 200 is incorporated in the image forming apparatus body 100, the loop accommodator 260 may be disposed on the immediately upstream side of the loop roller pair 132. Furthermore, in this case, this loop roller pair 132 may be constituted so as to be released by the press-contact releaser 282.

Moreover, with respect to the constitution of the above-described image forming apparatus 10, the main constitution has been described in order to describe the feature of the above-described embodiment. Accordingly, the present embodiment should not be limited to the above constitution. Moreover, it is not intended to exclude the constitution included in the general image forming apparatus 10.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus, comprising:

an image former that forms an image on a sheet;

a loading tray on which a plurality of sheets is loaded;

a regulator that regulates side faces, in a width direction orthogonal to a conveyance direction, of sheets loaded on the loading tray;

a sheet feeder that feeds a uppermost sheet of the sheets loaded on the loading tray;

a conveyance passage on which a sheet fed from the sheet feeder is conveyed;

a registration roller pair disposed on the conveyance passage;

a loop roller pair disposed on a one-stage upstream side than the registration roller pair;

a loop accommodator disposed on an upstream side than the loop roller pair on the conveyance passage so as to accommodate a formed loop;

a conveying roller pair disposed on an upstream side of the loop accommodator; and a processor that performs skew correction, based on sheet length, by bringing a leading end of a conveyed sheet in contact with the registration roller pair being in a stopped state and forming a first loop with the loop roller pair, and thereafter, refeeds the sheet with the registration roller to the image former by adjusting timing, wherein in a case of feeding a sheet with a length equal to or longer than a prescribed length, the processor forms a second loop with the conveying roller pair in the loop accommodator after having formed the first loop and before refeeding the sheet;

wherein in a case of feeding a sheet with a length smaller than the prescribed length, the processor forms only the first loop.

2. The image forming apparatus according to claim 1, wherein the loop accommodator includes a pair of guide plates facing each other across the conveyance passage on which a sheet passes, and one guide plate of the pair of guide plates is separated from the other guide plate so as to secure a space in which the second loop is formed.

3. The image forming apparatus according to claim 2, wherein when the leading end of the conveyed sheet passes through the loop accommodator, the processor makes the pair of guide plates in a closed state where the guide plates face each other and separate from each other with a prescribed distance; wherein during a period after the leading end of the sheet has passed through the loop accommodator and before the formation of the first loop has been completed, the processor starts a separation operation to separate the one guide plate; wherein when having started the refeeding of the sheet, the processor ends the separation operation; and wherein before a next sheet subsequent to the conveyed sheet passes through the loop accommodator, the processor makes the loop accommodator in the closed state.

4. The image forming apparatus according to claim 1, wherein the prescribed length is equal to a distance from the registration roller pair to a downstream end of the regulator.

5. The image foaming apparatus according to claim 1, wherein the image forming apparatus includes an image forming apparatus body and a sheet feeding apparatus constituted to be separable from the image foaming apparatus body, wherein the image forming apparatus body includes the registration roller pair, the loop roller pair, and the image former, wherein the sheet feeding apparatus includes the loading tray, the regulator, the sheet feeder, and the loop accommodator, and wherein the loop accommodator adjoins an exit roller pair located on a most downstream side within the conveying passage of the sheet feeding apparatus.

6. The image forming apparatus according to claim 5, further comprising a press-contact releaser that releases press-contact of the exit roller pair of the sheet feeding apparatus, wherein after the second loop has been formed, the processor actuates the press-contact releaser so as to release press-contact of the exit roller pair.

7. The image forming apparatus according to claim 1, further comprising a press-contact releaser that releases press-contact of at least one conveying roller pair among a plurality of conveying roller pairs disposed on the conveyance passage between the loop accommodator and the registration roller pair, wherein after the second loop has been formed, the processor actuates the press-contact releaser so as to release press-contact of the at least one conveying roller pair.

8. The image forming apparatus according to claim 7, wherein the press-contact releaser releases press-contact of a conveying roller pair located on an immediately downstream side of the loop accommodator.

9. The image forming apparatus according to claim 1, wherein in an inside of the image forming apparatus, there is provided a space to allow a user to perform processing to remove sheets of conveyance trouble having occurred on the conveyance passage, and the loop accommodator is constituted so as to accommodate the second loop in the space.

* * * * *